US006870506B2

(12) United States Patent
Chen et al.

(10) Patent No.: US 6,870,506 B2
(45) Date of Patent: Mar. 22, 2005

(54) MULTI-FREQUENCY ANTENNA WITH SINGLE LAYER AND FEEDING POINT

(75) Inventors: I-Fong Chen, Tao-Yuan (TW); Chia-Mei Peng, Pingchun (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 10/453,640

(22) Filed: Jun. 4, 2003

(65) Prior Publication Data

US 2004/0246179 A1 Dec. 9, 2004

(51) Int. Cl.[7] ..... H01Q 1/38

(52) U.S. Cl. ..... 343/700 MS; 343/803; 343/806; 343/846

(58) Field of Search ..... 343/700 MS, 795, 343/803, 806, 895, 846, 848

(56) References Cited

U.S. PATENT DOCUMENTS 3,025,524 A * 3/1962 Thies ..... 343/823
5,999,142 A * 12/1999 Jang ..... 343/834
6,130,651 A * 10/2000 Yanagisawa et al. ..... 343/895
6,317,099 B1 * 11/2001 Zimmerman et al. ..... 343/803
6,329,962 B2 * 12/2001 Ying ..... 343/895
6,630,910 B2 * 10/2003 Forster et al. ..... 343/806
6,642,893 B1 * 11/2003 Hebron et al. ..... 343/702
2003/0006940 A1 * 1/2003 Washiro et al. ..... 343/895

* cited by examiner

*Primary Examiner*—Tan Ho
(74) *Attorney, Agent, or Firm*—Troxell Law Office, PLLC

(57) ABSTRACT

A multi-frequency antenna with a single layer and a single feeding point, and especially an improved microstrip antenna with its bandwidths simplified and enlarged, it has a central microstrip with a set length and a set width; the bottom end of the central microstrip is used as a feeding point, the top end thereof is extended bilaterally to form respectively a first band section and a second ban section. The first band section is provided on the end thereof with a first open circuit point, and the second ban section is provided on the end thereof with a second open circuit point. A grounding line of a set length and a set width is located at a position a distance below the feeding point on the bottom end of the central microstrip. The lengths from the feeding point to an open circuit point on the end of the first band section and to an open circuit point on the end of the second ban section are both ¼ λ of the ban section to be used.

5 Claims, 2 Drawing Sheets

MULTI-FREQUENCY ANTENNA WITH SINGLE LAYER AND FEEDING POINT

BACKGROUND OF THE INVENTION

1. Field of the Invention

The present invention is related to a multi-frequency antenna with a single layer and a single feeding point, and especially to an improved microstrip antenna with its bandwidths simplified and enlarged.

2. Description of the Prior Art

In the initial period of marketing of mobile phones, exposed helix coils are mostly used as the main elements of antennas. Such helix-coil antennas widely used nowadays are generally divided into two main types—contractible and fixed types. No matter which kind of structure is used, an antenna normally has a specific length protruding out of the top surface of the body of a mobile phone. Therefore, various microstrip antennas have been developed, such microstrip antennas are characterized by planeness, concealment and non occupying too much volume.

Among modern planar inverted F-antennas (PIFA), dual-frequency antennas (IEEE TRANSACTIONS ON ANTENNAS AND PROPAGATION, VOL 45, NO.10, OCTOBER 1997) are of an ideal type of miniaturized microstrip antenna, however, by the fact that:

$$\frac{\text{Electrical volume of an antenna}}{\text{frequency band} \times \text{gain} \times \text{efficiency}} = \text{a constant}$$

So long as the antenna is made planar and miniaturized, its bandwidths and efficiency of radiation will be reduced and will be necessary to be improved.

SUMMARY OF THE INVENTION

The object of the present invention is to provide a multi-frequency antenna with a single layer and a single feeding point.

To get the above stated object, the present invention has a central microstrip with a set length and a set width; the bottom end of the central microstrip is used as a feeding point, the top end thereof is extended bilaterally to form respectively a first band section and a second ban section. The first band section is provided on the end thereof with a first open circuit point, and the second ban section is provided on the end thereof with a second open circuit point. A grounding line of a set length and a set width is located at a position a distance below the feeding point on the bottom end of the central microstrip. The lengths from the feeding point to an open circuit point on the end of the first band section and to an open circuit point on the end of the second ban section are both ¼ λ (wavelength) of the ban section to be used.

In the preferred embodiment, the impedance matching and the type of the radiation field of a multi-frequency antenna are determined in pursuance of the length of the grounding line as well as the distance between the grounding line and the feeding point.

In a practicable embodiment, the first band section and the second ban section are bent and wound at positions with the set widths of them on the antenna, and complementary cut angles for the bandwidths are provided at the joints of them with the central microstrip and at the turnings of them.

In the preferred embodiment, the widths of the first band section and the second ban section are set to be unequal.

And in the practicable embodiment, the first band section and the second ban section are provided at different vertical levels deviating from each other.

The present invention will be apparent after reading the detailed description of the preferred embodiment thereof in reference to the accompanying drawings.

DETAILED DESCRIPTION OF THE PREFERRED EMBODIMENT

Figure 1:
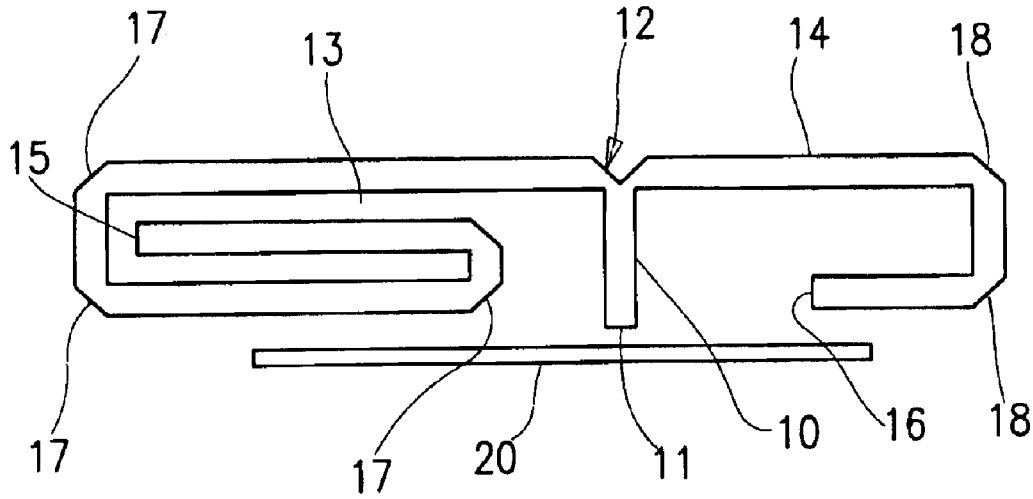
FIG. 1 is a perspective view of a first preferred embodiment of the present invention.

Referring to FIG. 1, in the preferred embodiment shown, the main body of the present invention is in the shape of "T" including a central microstrip 10 with a set length and a set width. The central microstrip 10 has a bottom end used as a feeding point 11; the top end thereof is extended bilaterally to form respectively a first band section 13 and a second ban section 14. The first band section 13 is provided on the end thereof with a first open circuit point 15, and the second ban section 14 is provided on the end thereof with a second open circuit point 16. A grounding line 20 of a set length and a set width is located at a position a distance below the feeding point 11 on the bottom end of the central microstrip 10.

The lengths from the feeding point 11 to the first open circuit point 15 on the end of the first band section 13 is ¼ λ of the ban section f1 to be used firstly; and the lengths from the feeding point 11 to the second open circuit point 16 on the end of the second ban section 14 is ¼ λ of the ban section f2 to be used secondly. To shorten the width of the front face of the entire antenna, the first band section 13 and the second ban section 14 are both bent and wound at positions at predetermined distances from the central microstrip 10.

The widths of the "T" shaped main body of the antenna (including the central microstrip 10, the first band section 13 and the second ban section 14) and the grounding line 20 will influence the bandwidths of the ban sections used, the length of the grounding line 20 used and the distance between the grounding line 20 and the feeding point 11 can decide the impedance matching and the type of the radiation field of the multi-frequency antenna. The grounding line 20 having the distance from the feeding point 11 thereby forms an effect of "Edge Perturbation"; this can have the function of increasing the bandwidths.

In the preferred embodiment shown, the central microstrip 10 of the main body in the shape of "T" can be provided at the joint of the first band section 13 with the second ban section 14 and the turnings of the first band section 13 and the second ban section 14 with cut angles to complement the bandwidths.

In the improved antenna structure stated above of the present invention, the two ban sections of different lengths are integrally connected, they can be open-stubs for each other, thereby a function of adjusting the impedance matching and the bandwidths can be obtained.

Figure 2:
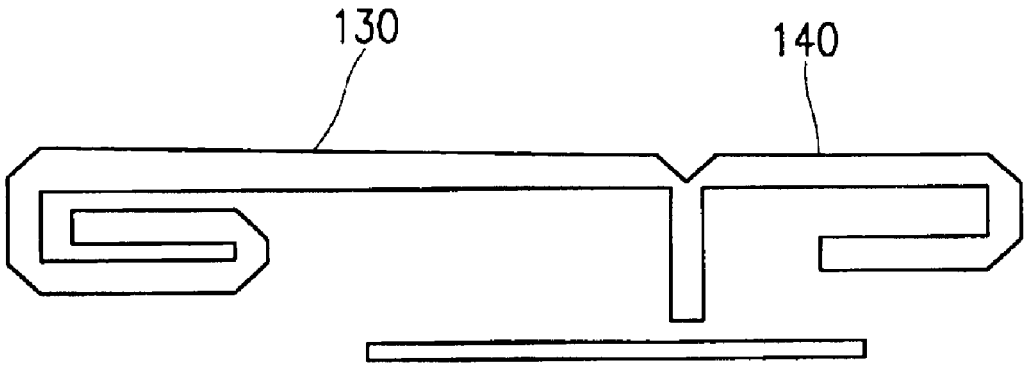
FIG. 2 is a perspective view of a second preferred embodiment of the present invention.

In the above stated preferred embodiment, the widths of the first band section 13 and the second ban section 14 are same; in another preferred embodiment shown in FIG. 2, the widths of a first band section 130 and a second ban section 140 are unequal, and they can also increase the bandwidths.

In the above stated preferred embodiment, the first band section 13 and the second ban section 14 forming two arms on the top end of the central microstrip 10 are on the same horizontal level; while in a practicable embodiment, the two ban sections are provided at different levels deviating form each other in the vertical altitude, so that the first band section 13 of the ban sections is higher than the second ban section 14.

The present invention can more simplify the structure of such a microstrip antenna and its operational bandwidths according to the improvement stated above; it surely is industrially valuable.

The preferred embodiments stated are only for illustrating the present invention. It will be apparent to those skilled in this art that various modifications or changes made to the elements of the present invention without departing from the spirit and scope of this invention shall fall within the scope of the appended claims.

What is claimed is:

1. A multi-frequency antenna with a single layer and a single feeding point, said antenna comprises a central microstrip with a set length and a set width, a bottom end of said central microstrip is used as the feeding point, a top end thereof is extended bilaterally to form respectively a first band section and a second band section, said first band section is provided on an end thereof with a first open circuit point, and said second band section is provided on an end thereof with a second open circuit point, a grounding line of a set length and a set width is provided at a position a distance below said feeding point on said bottom end of said central microstrip; the lengths from said feeding point to the first open circuit point on said end of said first band section and to the second open circuit point on said end of said second band section are both ¼ λ of one of said band sections to be used, wherein said feeding point and said grounding line are spaced apart a predetermined distance to form an edge perturbation effect for adjusting impedance matching and increasing a bandwidth.

2. The multi-frequency antenna with a single layer and a single feeding point as defined in claim 1, wherein said first band section and said second band section are both bent and wound at positions with set widths of them on said antenna.

3. The multi-frequency antenna with a single layer and a single feeding point as defined in claim 2, wherein said central microstrip is provided at a joint of said first band section with said second band section and at turnings of said first band section and said second band section with cut angles to complement bandwidths.

4. The multi-frequency antenna with a single layer and a single feeding point as defined in claim 1, wherein the widths of said first band section and said second band section are set to be unequal.

5. The multi-frequency antenna with a single layer and a single feeding point as defined in claim 1, wherein said first band section and said second band section are provided at different vertical levels deviating from each other.

* * * * *